US008061492B2

(12) United States Patent
Riedel et al.

(10) Patent No.: US 8,061,492 B2
(45) Date of Patent: Nov. 22, 2011

(54) SUITCASE FOR TRANSPORT OF TOOLS OR THE LIKE

(75) Inventors: Robert Byriel Riedel, Horsens (DK); Søren Xerxes Frahm, Horsens (DK)

(73) Assignee: Raaco International A/S, Nykobing Falster (DK)

( * ) Notice: Subject to any disclaimer, the term of this patent is extended or adjusted under 35 U.S.C. 154(b) by 0 days.

(21) Appl. No.: 12/918,121

(22) PCT Filed: Feb. 25, 2009

(86) PCT No.: PCT/DK2009/050043

§ 371 (c)(1), (2), (4) Date: Aug. 18, 2010

(87) PCT Pub. No.: WO2009/106082

PCT Pub. Date: Sep. 3, 2009

(65) Prior Publication Data

US 2010/0320108 A1 Dec. 23, 2010

(30) Foreign Application Priority Data

Feb. 25, 2008 (DK) ..... 2008 00258

(51) Int. Cl.
*A45C 13/26* (2006.01)

(52) U.S. Cl. ..... 190/118; 206/372; 220/318; 220/756

(58) Field of Classification Search ..... 206/349, 206/372, 373, 1.5; 220/752, 756, 762, 318; 190/100, 101, 115, 118–120
See application file for complete search history.

(56) References Cited

U.S. PATENT DOCUMENTS

| | | | | |
|---|---|---|---|---|
| 3,135,105 | A | 6/1964 | Brody | |
| 3,185,338 | A | 5/1965 | Henning | |
| 4,157,763 | A * | 6/1979 | Betlejewski et al. | 220/761 |
| 5,169,018 | A | 12/1992 | Fiore | |
| 7,494,011 | B2 * | 2/2009 | Henssler et al. | 220/762 |
| 2005/0072789 | A1 * | 4/2005 | Einav et al. | 220/756 |
| 2006/0091032 | A1 * | 5/2006 | Tsai | 206/373 |
| 2006/0186003 | A1 * | 8/2006 | Dost et al. | 206/349 |

FOREIGN PATENT DOCUMENTS

| | | | |
|---|---|---|---|
| CH | 344530 | A | 2/1960 |
| CH | 683585 | A5 | 4/1994 |
| DE | 38 07 435 | A1 | 9/1989 |
| DE | 94 08 090 | U1 | 9/1994 |
| EP | 1 671 559 | A1 | 6/2006 |

* cited by examiner

*Primary Examiner* — Luan K Bui
(74) *Attorney, Agent, or Firm* — The Nath Law Group; Jerald L. Meyer; Sungyeop Chung

(57) ABSTRACT

Suitcase for transport of tools or the like, which includes a box-shaped bottom (1), a corresponding lid (2) and a flip-up handle (3) on the side of the bottom (1). The bottom (1) and the lid (2) are connected with each other by one or more hinges. A lock is provided for locking the lid (2) to the bottom (1), and said lock includes a latch device (4), which is turnably mounted on the bottom (1) on the same side of the suitcase as the handle (3). Said latch device (4) is adapted so that by turning, it engages with the lid (2) and fixes the lid in its closed position. The latch device (4) and the handle (3) have interacting cam means (22 and 23), which effect turning of the latch device (4) into the locked position when the handle (3) is turned to flipped-up position.

5 Claims, 3 Drawing Sheets

SUITCASE FOR TRANSPORT OF TOOLS OR THE LIKE

This is a National Phase Application filed under 35 U.S.C. 371 as a national stage of PCT/DK2009/050043, filed Feb. 25, 2009, an application claiming foreign priority benefits under 35 USC 119 of Danish Application No. PA 2008 000258, filed Feb. 25, 2008, the content of each of which is hereby incorporated by reference in its entirety.

TECHNICAL FIELD

The invention relates to a suitcase for transport of tools or the like, which includes a box-shaped bottom, a corresponding lid and a flip-up handle on the side of the bottom, where the bottom and the lid are connected with each other by one or more hinges, and where there is a lock for locking the lid to the bottom.

BACKGROUND

It is known to transport tools or the like in suitcases of the above type. However, the problem of such suitcases is that sometimes the user forgets to lock the lid and thus prevent it from opening. The consequence is often that the lid opens and the contents fall out when the suitcase is lifted in the handle.

CH 683585 A5 discloses a suitcase, which includes a box-formed bottom with a corresponding lid and a flip-up handle on the side of the bottom. The flip-up handle forms part of a lock. When the handle is flipped-up, the lid is locked to the bottom thus avoiding that the contents fall out of the suitcase.

DISCLOSURE OF THE INVENTION

The object of the invention is to provide a suitcase, which shows great security in being reliably closed, when the suitcase is lifted in the handle.

According to the invention, this is achieved in that the lock includes a latch device, which is turnably mounted on the bottom on the same side of the suitcase as the handle, and which is adapted so that by turning, it engages with the lid and fixes the lid in its closed position, and in that the latch device and the handle have interacting cam means, which effect turning of the latch device into the locked position when the handle is turned to flipped-up position.

By this, it is achieved that when the user grips the handle, the lid is automatically locked in its closed position by flip-up of the handle. Provided that the lid has been closed properly before the handle is gripped, it will with certainty remain closed during the transport. By way of latch devices, the locking itself is not dependent on the handle. The lid can only be opened by separate release of the latch device, when the handle is flipped-down again. The latch device ensures stable and easy locking of the lid, and there is no risk that the lock unlocks during transport of the suitcase.

According to the invention the handle may have a substantially U-shaped shape and be turnably mounted at the legs of the U, and on each leg there may be a cam means, which interacts with a corresponding cam means on the latch device. This enables uniform load on the handle in each end. According to the invention, the latch device may also have a substantially U-shaped shape and be turnably mounted at the legs of the U, and on each leg there may be a cam means for interaction with a corresponding cam means on the handle. This leaves plenty of room for the user to be able to grip the flipped-down handle.

Further according to the invention, the latch device and the lid may have interacting manually releasable snap means, whereby the user can feel that the latch device engages appropriately with the lid of the suitcase, and it remains engaged with the lid until subjected to an opening force Finally according to the invention, the cam means of the handle and of the latch device may consist of surfaces sliding against each other, and each surface having the shape of cylinder surfaces with a generatrix extending parallel with the axis of rotation of the handle and the latch device, and the interacting surfaces are adapted to disengage from each other by turning of the handle away from the flipped-up position and back to the flipped-down position, while the latch device remains engaged with the lid.

In an especially simple way, this ensures the automatic locking of the lid by flip-up of the handle as well as release of the latch device by flip-down of the handle.

BRIEF DESCRIPTION OF THE DRAWING

The invention is explained in detail below with reference to the drawing, in which.

BEST MODE OF THE INVENTION

Figure 1:
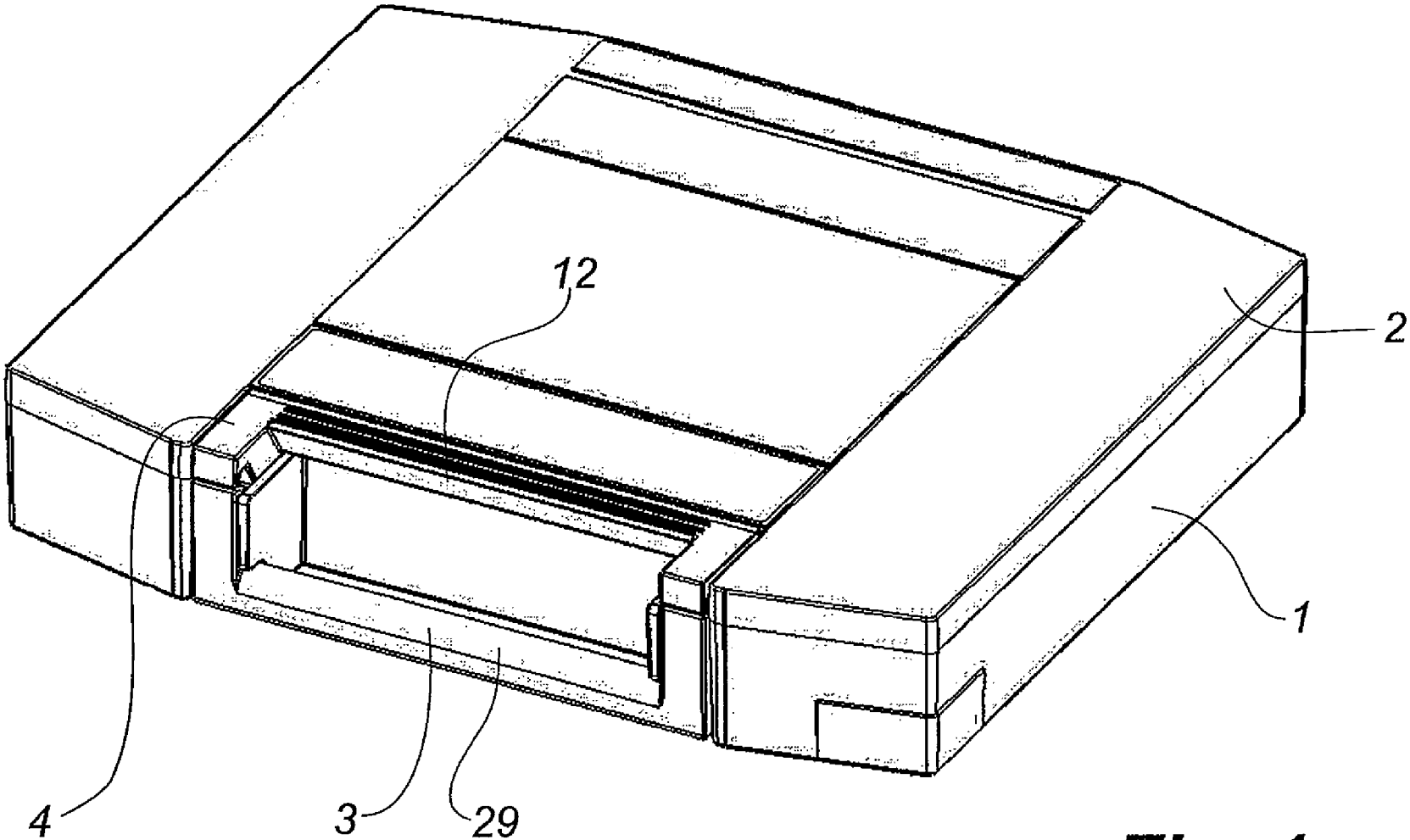
FIG. 1 shows a suitcase according to the invention, seen in perspective view, FIG. 2 the same, seen partly cut through, FIG. 3 shows the framed area shown in FIG. 2, seen in a larger scale than in FIG. 2, and shows the handle in flipped-down position and a latch device in locked engagement with the lid of the suitcase, FIG. 4 the same, but with the latch device in unlocked position, FIG. 5 the same as FIG. 4, but with the lid opened, FIG. 6 the same as FIG. 4, but with the lid closed again, FIG. 7 the same as FIG. 6, but with the handle in partly flipped-up position, FIG. 8 the same as FIG. 7, but with the handle in completely flipped-up position, FIG. 9 the same as FIG. 8, but with the handle in flipped-down position.

The suitcase shown in FIG. 1, and which is provided for accommodating and transporting tools and the like, includes a bottom 1 and a lid 2, which are connected with each other by hinges in a way not shown in detail. On the outside of the container, the bottom 1 and the lid 2 are a little extended at the front in such way that an outwardly turned cavity is provided for accommodation of a handle 3, which is adapted to interact with a latch device 4 as described below. The handle 3 and the latch device 4 are formed in such way that they fit into the said cavity and such that along the outside surfaces they are flush with the front of the bottom 1 as well as the front and upper surface of the lid 2, respectively.

As is especially evident from the following FIG. 2-9, the handle 3 is U-shaped and the legs 5, 6 of the U are turnably mounted on each their axle 7, which is secured on the corresponding outwardly extending parts of the bottom. The axles 7 are accommodated in a slot 8 formed in each leg 6, said slot is ending in a round groove with a little larger diameter than the slot 8, such that the axle 7 is connected to the leg 6 by snap effect. In the same way, the latch device 4 is turnably mounted around an axle 9. The latch device 4 is also U-shaped, and the legs 10 and 11, seen from the ends, have a nearly triangular shape, where the axle 9 is accommodated in a groove near the apex of the triangle. Together with the transverse beam 12 of the U, the legs 10 and 11 of the latch device 4, said legs 10 and 11 being connected with the beam 12, form a projection 13, which has a protruding tip 14 along its upper edge and a downwardly protruding rib 15 along its bottom edge. The tip 14 is adapted to be accommodated in a bevelled edge 16 along the upper side of the lid 2, and the rib 15 is adapted so as to engage in a groove 17 in a protruding projection 18 on the lid 2. The tip 14 and the rib 15 on the projection 13 are adapted so as to interact in the said way with the lid 2, when the lid 2 is in closed position on the bottom 1 of the suitcase. This is for instance the case in FIG. 3

Figures 2, 3, 4, 5:
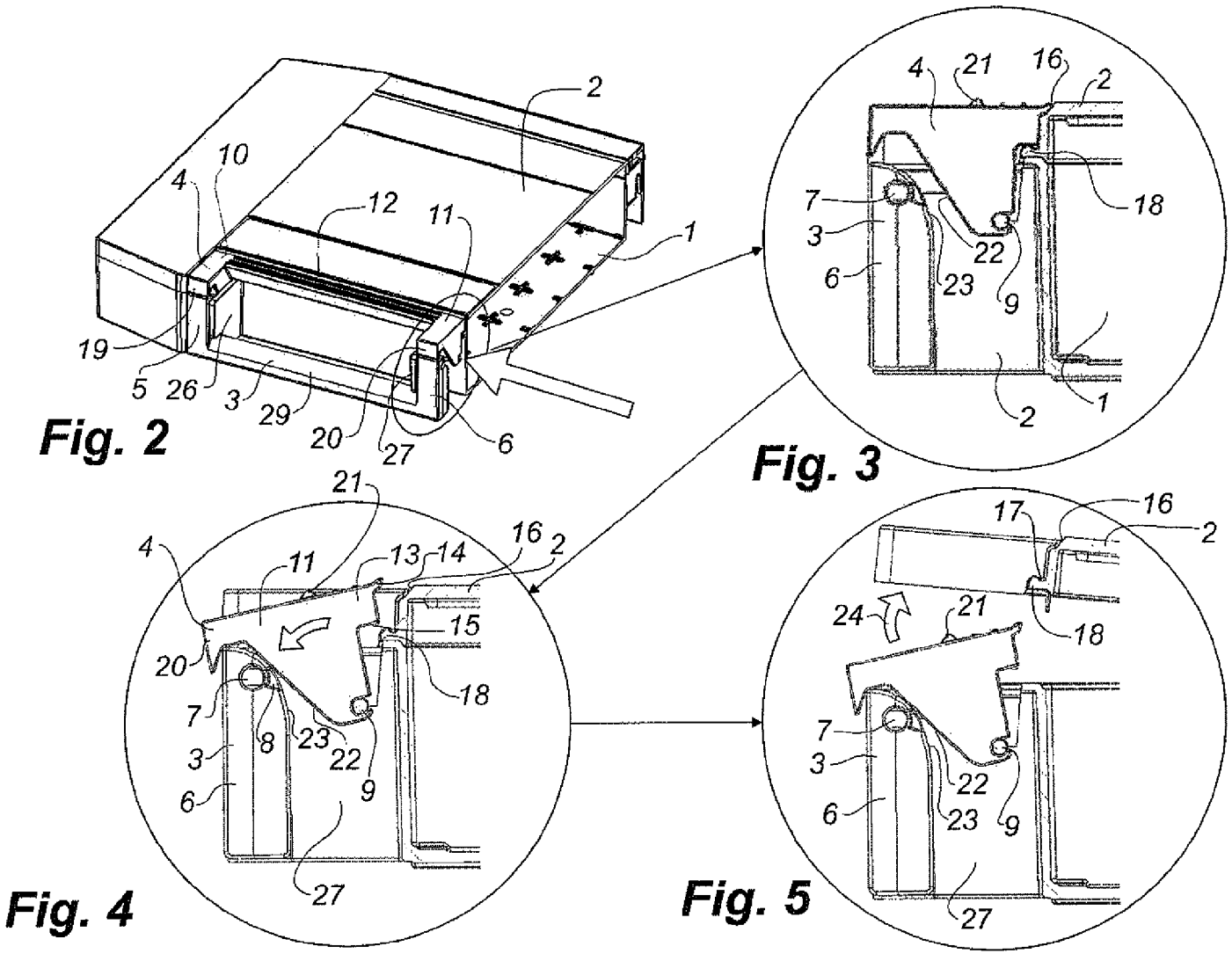
Figure 7:
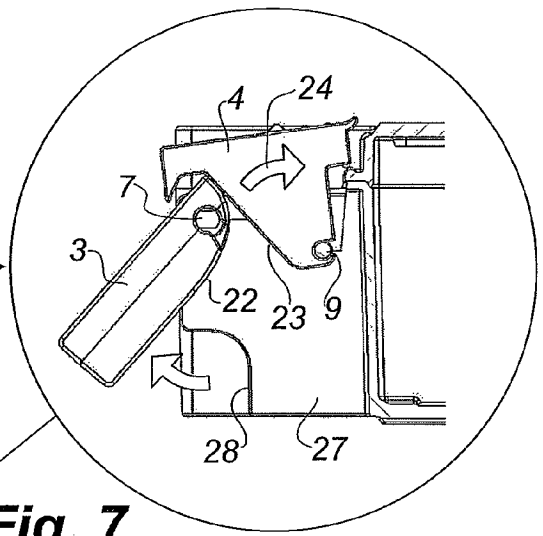
Figure 9:
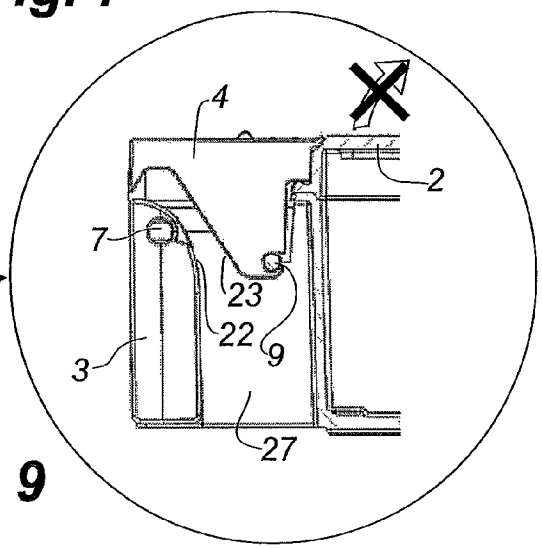
Figure 6:
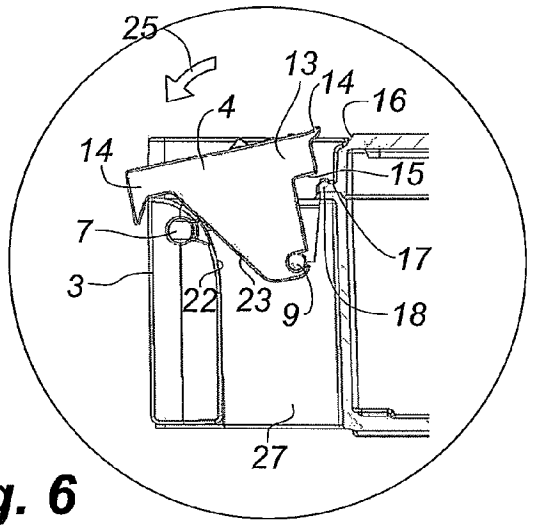
Figure 8:
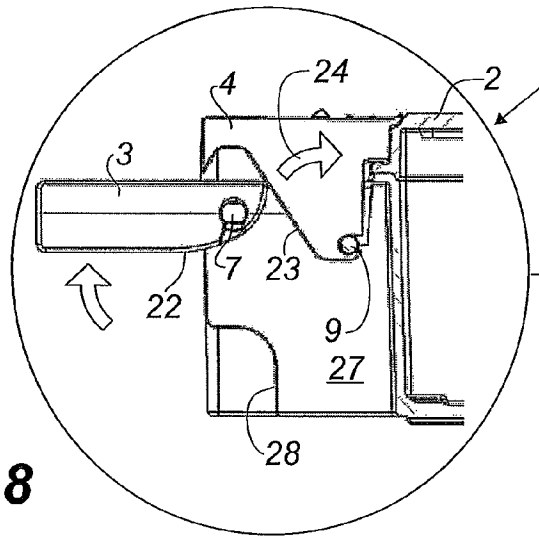

Along the edge opposite the projection 13, the legs 10, 11 of the latch device 4 have a projection 19, 20, which have such shape that they follow the adjacent outline of the suitcase and also enable the latch device 4 to tip from the position shown in FIG. 3 to the position shown in FIG. 4. In the position shown in FIG. 3 the latch device 4 secures the lid 2 on the bottom 1, whereas in FIG. 4 it releases the lid 2, such that the lid 2 may be tipped up, as shown in FIG. 5. The projection 13 interacts with the lid 2 in such way that they engage due to a snap effect, and the engagement may be maintained according to desire. The engagement is releasable by manual action on the latch device 4, for instance by gripping the transverse beam supported by upwardly protruding ribs 21 on the upper side of the latch device 4. By this, the latch device 4 may be moved from the position shown in FIG. 3 to the position shown in FIG. 4 by manual action.

As is evident from FIG. 6-9 especially, the handle 3 and the latch device 4 both have cylinder-shaped surfaces with a rectilinear generatrix extending parallel with the axles 7 and 9. The said surfaces 22 and 23, respectively, are adapted so as to interact with each other in a cam-like way, so that by movement from the position against the bottom 1 to a flipped-up position (see FIG. 8), the handle 3 moves, as is evident from FIG. 6-9, the latch device 4 as shown in the drawing clockwise around the axle 9 (see the arrow 24) towards the closed engagement of the latch device 4 with the lid 2 (see FIG. 8). In this position, the handle 3 secures the engagement of the latch device 4 with the lid 2, so that this cannot be opened. When the handle 3 is led back to the flipped-down position (see FIG. 9), the latch device 4 remains in the locked engagement with the lid 2, until it is manually moved counterclockwise back again (see the arrow 25).

As is evident from the drawing, both the legs 5 and 6 of the handle 3 as well as the legs 10 and 11 of the latch device 4 are partly covered by plate pieces 26, 27, respectively, which are fixed on the bottom 1. FIG. 3-9 show the plate piece 27 from its side turning towards the legs 10 and 11, and as is evident from FIG. 8 it has a recess 28 for accommodation of the transverse beam 29 of the handle.

The handle 3 and the latch device 4 are made of appropriate materials and with a shape corresponding to the suitcase in question. The axles 7 and 9, around which they are mounted, are secured appropriately on the suitcase in a way not shown.

The invention has been described with reference to a preferred embodiment. Many amendments may be made without deviating from the scope of the invention. For instance, the handle 3 and the latch device 4 may have other shapes than the described U-shapes. The handle 3 may have a U-shape, whereas the latch device 4 may comprise two parts corresponding to each of the legs of the handle 3, said parts being adapted so as to engage with the lid in a distance from each other.

The invention claimed is:

1. A suitcase for transport of tools, which includes a box-shaped bottom (1), a corresponding lid (2) and a flip-up handle (3) on the side of the bottom (1), where the bottom (1) and the lid (2) are connected with each other by one or more hinges, and where there is a lock for locking the lid (2) to the bottom (1), characterized in that the lock includes a latch device (4), which is turnably mounted on the bottom (1) on the same side of the suitcase as the handle (3), and which is adapted so that by turning, it engages with the lid (2) and fixes the lid in its closed position, and in that the latch device (4) and the handle (3) have interacting cam means (22,23), which effect turning of the latch device (4) into the locked position when the handle (3) is turned to flipped-up position.

2. The suitcase according to claim 1, characterized in that the handle (3) comprises legs (5, 6), and in that the handle (3) has a substantially U-shaped shape and is turnably mounted at the legs (5, 6) of the U-shaped handle (3), and in that on each leg (5, 6) there is a cam means (23) of the interacting cam means (22,23), which interacts with a corresponding cam means (22) of the interacting cam means (22,23) on the latch device (4).

3. The suitcase according to claim 1, characterized in that the latch device (4) comprises legs (10, 11), and in that the latch device (4) has a substantially U-shaped shape and is turnably mounted at the legs (10, 11) of the U-shaped latch device (4), and in that on each leg (10, 11) there is a cam means (22) of the interacting cam means (22,23) for interaction with a corresponding cam means (23) of the interacting cam means (22,23) on the handle (3).

4. The suitcase according to claim 1, characterized in that the latch device (4) and the lid (2) have interacting manually releasable snap means.

5. The suitcase according to claim 1, characterized in that the cam means (22, 23) of the handle (3) and the latch device (4) comprise surfaces sliding against each other, and each surface having the shape of cylinder surfaces with a generatrix extending parallel with the axis of rotation of the handle (3) and the latch device (4), and the interacting surfaces are adapted to disengage from each other by turning of the handle (3) away from the flipped-up position and back to the flipped-down position, while the latch device (4) remains engaged with the lid (2).

* * * * *